US007901520B2

(12) United States Patent
Yoshihara

(10) Patent No.: US 7,901,520 B2
(45) Date of Patent: Mar. 8, 2011

(54) SPRING WIRE ROD EXCELLING IN FATIGUE CHARACTERISTICS

(75) Inventor: Nao Yoshihara, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 425 days.

(21) Appl. No.: 12/146,755

(22) Filed: Jun. 26, 2008

(65) Prior Publication Data

US 2009/0025832 A1 Jan. 29, 2009

(30) Foreign Application Priority Data

Jul. 23, 2007 (JP) ..... 2007-191234

(51) Int. Cl.
*C22C 38/28* (2006.01)
*C22C 38/50* (2006.01)

(52) U.S. Cl. ..... 148/333; 148/908; 148/580; 148/334; 148/335

(58) Field of Classification Search ..... 148/320, 148/333–335, 580, 908
See application file for complete search history.

(56) References Cited

U.S. PATENT DOCUMENTS

| | | | | |
|---|---|---|---|---|
| 6,224,686 | B1 * | 5/2001 | Aoki et al. | 148/230 |
| 6,328,820 | B1 | 12/2001 | Yamamoto et al. | |
| 6,338,763 | B1 * | 1/2002 | Hashimura et al. | 148/333 |
| 7,438,770 | B2 * | 10/2008 | Yuse et al. | 148/320 |

FOREIGN PATENT DOCUMENTS

| | | |
|---|---|---|
| EP | 1 783 239 A1 | 5/2007 |
| JP | 2005-2441 | 1/2005 |
| WO | WO 2007/080256 A1 | 7/2007 |

OTHER PUBLICATIONS

U.S. Appl. No. 12/444,001, filed Apr. 2, 2009, Yoshihara.
T. Abe, et al., "Gigacycle fatigue properties of 1800 MPa class spring steels", Fitigue and Fracture of Engineering Materials and Structures, vol. 27, No. 2, XP-002497979, Feb. 2004, pp. 159-167.
Peter Spiekermann, et al., "Legierungen—ein besonderes patentrechtliches Problem?—Legierungsprüfungim Europäischen Patentamt", Mitteilungen der deutschen Patentanwaelte, XP-000961882, Jan. 1, 1993, pp. 178-190.

* cited by examiner

*Primary Examiner* — Deborah Yee
(74) *Attorney, Agent, or Firm* — Oblon, Spivak, McClelland, Maier & Neustadt, L.L.P.

(57) ABSTRACT

Disclosed herein is a spring wire rod excelling in fatigue characteristics. It contains TiN inclusions having a specific size defined by the ratio of each group in all the visual fields as follows:

(1) Visual fields in which the maximum thickness is no larger than 5 μm: less than 5%
(2) Visual fields in which the maximum thickness is larger than 5 μm and no larger than 10 μm: no more than 30%
(3) Visual fields in which the maximum thickness is larger than 10 μm and no larger than 25 μm: no less than 70%
(4) Visual fields in which the maximum thickness is larger than 25 μm: less than 5%

The visual field is the cross section passing through the center line of the wire rod.

7 Claims, 1 Drawing Sheet

SPRING WIRE ROD EXCELLING IN FATIGUE CHARACTERISTICS

BACKGROUND OF THE INVENTION

1. Field of the Invention

The present invention relates to a spring wire rod. More particularly, the present invention relates to a spring wire rod to be made into valve springs, clutch springs, suspension springs, etc. with improved fatigue characteristics.

2. Description of the Related Art

It is known that any spring steel containing hard non-metallic inclusions is subject to breakage triggered by them. One way proposed so far to improve the fatigue characteristics of spring steel, particularly silicon killed steel, is by conversion of hard inclusions into those having a lower melting point. U.S. Pat. No. 6,328,820, for example, teaches that steel improves in fatigue characteristics if oxide inclusions therein have a controlled composition ($SiO_2$: 35-75 wt %, $Al_2O_3$: 5-30 wt %, CaO: 10-50 wt %, MgO: 5 wt % or less), which lowers the melting point below 1400° C., and a reduced thickness.

Aluminum killed steel, however, is not studied so deeply as silicon killed steel. A common measure employed for aluminum killed steel is the reduction of oxygen content in steel which leads to fine oxide inclusions. Japanese Patent Laid-open No. 2005-2441 discloses a method for reducing the average particle diameter of inclusions (sulfides, nitrides, and compounds thereof) below 7 μm in order to improve the resistance of notch fatigue characteristics of aluminum killed steel.

OBJECT AND SUMMARY OF THE INVENTION

It is an object of the present invention to provide a sophisticated method for controlling inclusions which improves the fatigue characteristics of spring steel.

It is another object of the present invention to provide a method for improving fatigue characteristics which can be applied to aluminum killed steel as well as silicon killed steel.

It is further another object of the present invention to provide a method for improving the fatigue characteristics of steel with Ti added either in a small amount or in an increased amount.

In order to achieve the above-mentioned objects, the present inventors carried out a series of researches, which led to the finding that TiN inclusions aggravate fatigue characteristics when they are coarse as a matter of course but, unexpectedly, they are also detrimental to fatigue characteristics when they are excessively thin. It was found that desirable fatigue characteristics are obtained only when TiN inclusions have an intermediate thickness. To be specific, TiN inclusions having the maximum thickness of about 10-25 μm produced the best result in the test in which TiN inclusions are classified into four groups each having the maximum thickness of smaller than 5 μm, 5-10 μm, 10-25 μm, and larger than 25 μm. The present invention was completed on the basis of these findings.

The gist of the present invention resides in a spring wire rod which is characterized by containing C: 0.35-0.70% (by mass hereinafter)
Si: 1.5-2.5%
Mn: 0.05-1.5%
Cr: 0.1-2%
Ti: 0.0010-0.10%
Al: 0.001-0.05% and also by containing TiN inclusions which are specified according to their thickness as follows.

The spring wire rod is cut along its center line and the resulting longitudinal cross-section is divided into two rectangles as observation regions, which are arranged symmetrically about the center line. Each rectangle measures 20 mm in the longitudinal direction and D/4 mm in the crosswise direction from the surface of the wire rod, where D is the diameter of the wire rod. Two observation regions constitute one visual field. The maximum thickness of TiN inclusions is measured in more than 20 visual fields, and the visual fields are classified into four groups each having the maximum thickness no larger than 5 μm, larger than 5 μm and no larger than 10 μm, larger than 10 μm and no larger than 25 μm, and larger than 25 μm. The ratio of each group in all the visual fields is as follows.

(1) Visual fields in which the maximum thickness is no larger than 5 μm: less than 5%

(2) Visual fields in which the maximum thickness is larger than 5 μm and no larger than 10 μm: no more than 30%

(3) Visual fields in which the maximum thickness is larger than 10 μm and no larger than 25 μm: no less than 70%

(4) Visual fields in which the maximum thickness is larger than 25 μm: less than 5%

The wire rod specified above contains a reduced amount of coarse TiN inclusions of Class 4 (having a maximum thickness exceeding 25 μm), with TiN inclusions that trigger breakage becoming smaller in size as well as aspect ratio. To be specific, the inclusion which triggers breakage has a major axis smaller than 30 μm and an aspect ratio smaller than 4.0 which were determined as follows. Fifty specimens taken from the wire rod were quenched and annealed and then subjected to rotary bending fatigue test (of Ono type) with a load stress of 750 MPa. The specimen which had broken first at TiN inclusion was examined for its fracture surface by observation under a scanning electron microscope.

The above-mentioned wire rod contains inevitable impurities such as N, O, P, and S, with the following tolerance.

N: no more than 0.006%
O: no more than 0.001%
P: no more than 0.015%
S: no more than 0.015%

The spring wire rod according to the present invention may additionally contain specific elements listed below for its improvement in characteristic properties.

(a) Cu: no more than 0.7%, and/or
Ni: no more than 0.8%.
(b) V: no more than 0.4%, and/or
Nb: no more than 0.1%.
(c) Mo: no more than 0.5%.
(d) B: no more than 0.005%.

Incidentally, the term "TiN inclusions" as used in the present invention denotes those inclusions composed mainly of TiN. The content of Ti may be no less than 50 atom % (preferably no less than 80 atom %, more preferably no less than 90 atom %) of the total amount of metallic elements including Al, V, Ca, etc. The content of N may be no less than 50 atom % (preferably no less than 80 atom %, more preferably no less than 90 atom %) of the total amount of non-metallic elements including C. Whether or not inclusions in the wire rod are TiN inclusions can be determined by EPMA (electron probe microanalysis). The TiN inclusions usually assume comparatively large cubes.

The spring wire rod according to the present invention has improved fatigue characteristics because it contains TiN inclusions with an adequately controlled size or thickness.

DESCRIPTION OF THE PREFERRED EMBODIMENTS

Figure 1:
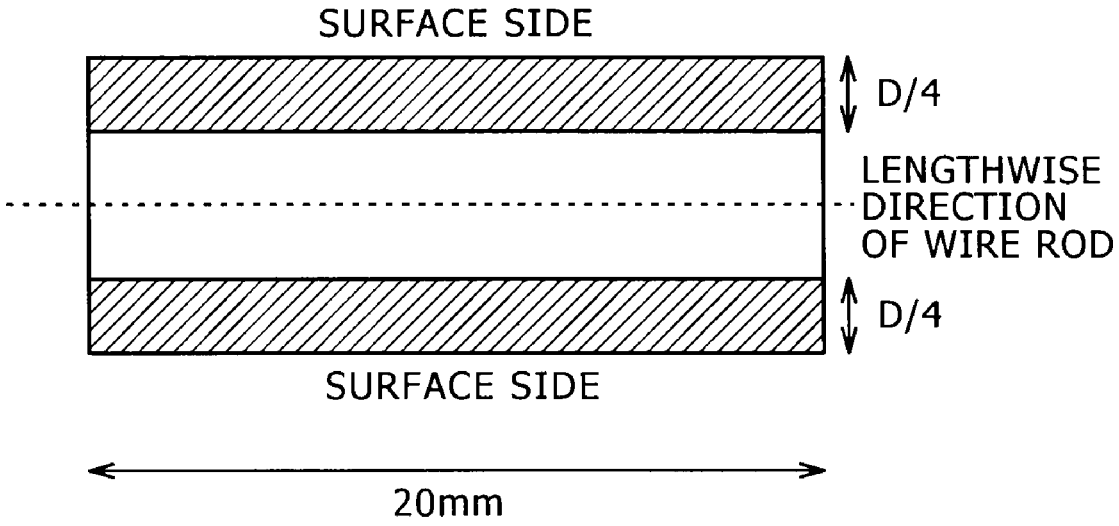
FIG. 1 is a diagram showing one visual field to measure the maximum thickness of TiN inclusions.

The present invention is designed to control TiN inclusions such that they have a statistically adequate size or thickness. The controlled TiN inclusions having an intermediate size or thickness dominate, with those having an excessively small size or thickness or excessively large size or thickness decreasing. The spring wire rod containing controlled TiN inclusions exhibits improved fatigue characteristics. Not only coarse TiN inclusions trigger breakage but excessively fine TiN inclusions also aggravates fatigue characteristics. A probable reason for this is that fine TiN inclusions have a large aspect ratio, causing stress concentration.

The statistical distribution of TiN inclusions is investigated by the method which is explained below with reference to FIG. 1. FIG. 1 is a longitudinal sectional view of the spring wire rod cut along its center line. The hatched rectangular area is surrounded by two sides, each D/4 mm long (D=the diameter of the wire rod), extending inward from the surface of the wire rod and by another two sides, each 20 mm long, extending in the lengthwise direction of the wire rod. Two rectangular areas are defined in each longitudinal sectional area, and they constitute one visual field. More than 20 visual fields are examined to measure the maximum thickness of TiN inclusions, and the examined visual fields are classified into four groups according to the maximum thickness of TiN inclusions in the following ranges.

No larger than 5 μm.

Larger than 5 μm and no larger than 10 μm.

Larger than 10 μm and no larger than 25 μm.

Larger than 25 μm.

The spring wire rod according to the present invention is characterized by the ratio of each group in all the visual fields as follows.

(1) Visual fields in which the maximum thickness is no larger than 5 μm: less than 5%

(2) Visual fields in which the maximum thickness is larger than 5 μm and no larger than 10 μm: no more than 30%

(3) Visual fields in which the maximum thickness is larger than 10 μm and no larger than 25 μm: no less than 70%

(4) Visual fields in which the maximum thickness is larger than 25 μm: less than 5%

The ratio of group (4) which exceeds 5% means that the wire rod contains coarse TiN inclusions which trigger fatigue breakage and hence is poor in fatigue characteristics. By contrast, the ratio of group (1) which exceeds 5% means that the wire rod contains excessively fine TiN inclusions which concentrate stresses and hence is poor in fatigue characteristics. The preferred ratio of groups (4) and (1) should be less than 3%, particularly 0%.

The ratio of group (2) is not so detrimental as the ratio of group (1) but is more detrimental than the optimal ratio of group (3). Therefore, it should be as small as possible, preferably less than 20%, particularly less than 10%.

On the other hand, the ratio of group (3) is least detrimental to fatigue characteristics; therefore, it should be as large as possible, preferably larger than 80%, particularly larger than 90%.

The wire rod according to the present invention contains a reduced amount of coarse TiN inclusions, as apparent from the ratio of group (4). Therefore, it contains smaller TiN inclusions that trigger breakage. Moreover, it also contains a reduced amount of fine TiN inclusions (with a large aspect ratio) that trigger breakage, as apparent from the ratio of group (1). These fine TiN inclusions have a smaller aspect ratio. To be specific, the wire rod according to the present invention is characterized by containing breakage-triggering inclusions with a major axis (thickness) smaller than 30 μm (preferably smaller than 25 μm) and an aspect ratio smaller than 4.0 (preferably smaller than 3.5). The dimensions of such inclusions are determined by observation of fracture surface under a scanning electron microscope. The fracture surface is selected from a test specimen which has broken first at TiN inclusions in rotary bending fatigue test (of Ono type) with a load stress of 750 MPa. The fatigue test is performed on refined 50 test specimens taken from the wire rod.

Any known means may be employed in combination to control the size (or the maximum thickness) of TiN inclusions so that the ratio of visual fields for each group is within the above-mentioned range. (Such control reduces the size and aspect ratio of TiN inclusions that trigger breakage.) This object is achieved if the wire rod is produced by continuous casting, blooming, and hot rolling under adequate conditions in combination. For example, rapid cooling in the solidifying stage of continuous casting makes TiN inclusions fine, with their aspect ratio increased. Blooming preceded by heating at a higher temperature for a longer period makes TiN inclusions coarse and decreases TiN inclusions with a large aspect ratio. Blooming followed by slow cooling also makes TiN inclusions coarse and decreases TiN inclusions with a large aspect ratio.

Preferred manufacturing conditions to easily control TiN inclusions, which subtly vary depending on various factors, may be established based on the idea of controlling the distribution of the maximum thickness of TiN inclusions (and hence controlling the size and aspect ratio of TiN inclusions that trigger breakage) by making TiN inclusions once excessively fine (and increasing TiN inclusion with a large aspect ratio) in the solidifying stage in continuous casting and subsequently enlarging TiN inclusions (and reducing TiN inclusions with a large aspect ratio) by raising the heating temperature and extending the heating period prior to blooming and reducing the cooling rate after blooming.

The manufacturing conditions that follow are preferable. Continuous casing is followed by cooling at a rate of 0.10-1° C. per sec from 1500° C. to 1400° C. This cooling rate may be adjusted according to the results of controlling TiN inclusions. If coarse TiN inclusions account for a large portion (or breakage-triggering TiN inclusions become large in size) at a cooling rate of 0.1-0.2° C. per sec, then the cooling rate should be readjusted in the range of 0.2-1.0° C. per sec. Conversely, if fine TiN inclusions account for a large portion (or breakage-triggering TiN inclusions become large in aspect ratio), then the cooling rate should be reduced.

Incidentally, slow cooling at 0.1° C. per sec or below results in a broad thickness distribution of TiN inclusions, in which case the prescribed ratio of visual fields with the desired range (10-25 μm) is not obtained.

The heating temperature (or the surface temperature of billet) for soaking prior to blooming should be in the range of 1200 to 1400° C. It may be readjusted according to need. The duration of heating should be in the range of 1 to 3 hours. The heating temperature in the higher range (say, 1320-1400° C.) leads to a high ratio of coarse TiN inclusions (or a large size of break-triggering TiN inclusions). In this case, the duration of heating should be reduced (say, 1-1.5 hours).

The cooling rate (at 1200° C. to 800° C.) after blooming should be in the range of 0.01 to 0.3° C. per sec. Cooling by standing proceeds at a rate of 0.3° C. per sec or above. A cooling rate lower than 0.3° C. can be achieved by covering the billet with a heat-insulating sheet. If found inadequate, the cooling rate should be readjusted.

Blooming is followed by hot rolling to produce the spring wire rod according to the present invention which is in the as-rolled form (without refining). For application to springs, the wire rod undergoes refining in an adequate stage after drawing or spring winding.

The spring wire rod according to the present invention has an adequately controlled chemical composition as shown below.

C: 0.35-0.70%

C is an element to guarantee the strength (or hardness) of the wire rod which has undergone quenching and annealing. It also improves resistance to atmosphere. However, excess C deteriorates toughness and fatigue characteristics owing to increased sensitivity to surface defects and inclusions. An adequate amount of C should be no less than 0.35% (preferably no less than 0.38% and more preferably no less than 0.45%) and no more than 0.70% (preferably no more than 0.65% and more preferably no more than 0.61%).

Si: 1.5-2.5%

Si is an element that contributes to solid solution hardening, thereby improving matrix strength and proof stress. However, an excess amount of Si causes ferrite decarburization in the steel surface during heat treatment and hence it hardly dissolves in steel. An adequate amount of Si should be no less than 1.5% (preferably no less than 1.6% and more preferably no less than 1.7%) and no more than 2.5% (preferably no more than 2.4% and more preferably no more than 2.2%).

Mn: 0.05-1.5%

Mn is an element to improve hardenability as well as toughness by trapping dissolved S (to form MnS) in steel. However, excess Mn improves hardenability more than necessary, thereby causing temper cracking at the time of quenching and annealing in the spring manufacturing process. Therefor, an adequate amount of Mn should be no less than 0.05% (preferably no less than 0.15% and more preferably no less than 0.3%) and no more than 1.5% (preferably no more than 1.2% and more preferably no more than 1.0%).

Cr: 0.1-2%

Cr is an element to improve the matrix strength of steel through solid solution hardening. It also improves hardenability like Mn. However, excess Cr makes steel brittle and more sensitive to inclusions, thereby deteriorating fatigue characteristics. Therefor, an adequate amount of Cr should be no less than 0.1% (preferably no less than 0.5% and more preferably no less than 0.9%) and no more than 2% (preferably no more than 1.8% and more preferably no more than 1.5%).

Ti: 0.0010-0.10%

Ti is an element to make austenite crystal grains fine after quenching and annealing, thereby improving resistance to atmosphere and resistance to hydrogen brittleness. However, excess Ti tends to precipitate coarse nitrides, thereby aggravating fatigue characteristics. Therefore, an adequate amount of Ti should be no less than 0.0010% (preferably no less than 0.005% and more preferably no less than 0.01% and particularly no less than 0.02%) and no more than 0.10% (preferably no more than 0.09% and more preferably no more than 0.08%).

Al: 0.001-0.05%

Al is an element to form fine nitrides with nitrogen. The fine nitrides produce the pinning effect that makes crystal grains fine. Al also functions as a deoxidizer at the time of steel melting. However, excess Al increases the amount of oxide inclusions, thereby deteriorating fatigue characteristics. Therefore, an adequate amount of Al should be no less than 0.001% (preferably no less than 0.003% and more preferably no less than 0.01%) and no more than 0.05% (preferably no more than 0.04% and more preferably no more than 0.03%).

The spring wire rod according to the present invention contains the foregoing essential components, with the remainder being iron and inevitable impurities and optional elements. The inevitable impurities denote any impurities resulting from raw materials, subsidiary materials, and manufacturing equipment. They include N, O, P, and S. These elements should preferably be controlled within the following range.

N: no more than 0.006%

Excess N makes TiN inclusions coarse. Therefore, an adequate amount of N should be no more than 0.006%, preferably no more than 0.005%. On the other hand, the smaller the amount of N, the better the steel characteristics. However, reducing the amount of N excessively is uneconomical, without additional effects. Therefore, an adequate amount of N should be no less than 0.001%, preferably no less than 0.002%. The amount of N should be properly adjusted so that the size of TiN inclusions is within the range specified in the present invention.

O: no more than 0.001%

O combines with Al etc. to form oxide inclusions. Thus, the amount of O should be no more than 0.001%, preferably no more than 0.0008%. The smaller, the better. However, the amount of O should be no less than 0.0002%, preferably no less than 0.0003%, from the economical point of view.

P: no more than 0.015%

P is a harmful element which segregate at the grain boundary of austenite, thereby making the grain boundary brittle and deteriorating the fatigue characteristics. The amount of P should be as small as possible, for example, no more than 0.015%, preferably no more than 0.013%. It is practically impossible to reduce the P content to 0% because P enters inevitably during steel production.

S: no more than 0.015%

Like P, S is a harmful element which segregate at the grain boundary of austenite, thereby making the grain boundary brittle and deteriorating the fatigue characteristics. The amount of S should be as small as possible, for example, no more than 0.015%, preferably no more than 0.013%. It is practically impossible to reduce the S content to 0% because S enters inevitably during steel production.

Additional elements listed below may optionally be added alone or in combination with one another.

Cu: no more than 0.7% and/or

Ni: no more than 0.8%

Cu and Ni effectively suppress ferrite decarburization that occurs during hot rolling to produce the wire rod or during heat treatment of springs. They may be added to the wire rod according to need. In addition, Cu also enhances corrosion resistance, and Ni improves toughness of springs after quenching and annealing. A desired amount of Cu is no less than 0.01% (preferably no less than 0.1%, particularly no less than 0.2%), and a desired amount of Ni is no less than 0.05% (preferably no less than 0.1%, particularly no less than 0.25%).

However, excess Cu tends to cause cracking at the time of hot rolling, and excess Ni increases residual austenite at the time of quenching and annealing, thereby decreasing tensile strength. Therefore, the amount of Cu should be no more than 0.7% (preferably no more than 0.6%, more preferably no more than 0.5%), and the amount of Ni should be no more than 0.8% (preferably no more than 0.7%, more preferably no more than 0.55%).

V: no more than 0.4% and/or

Nb: no more than 0.1%

V and Nb combine with carbon and nitrogen to form fine carbides and nitrides, thereby improving hydrogen brittleness resistance and fatigue characteristics. They also improve toughness, proof stress, and settling resistance owing to their effect of making crystal grains fine. They may be added to the wire rod according to need. A desired amount of V is no less than 0.07% (preferably no less than 0.10%), and a desired amount of Nb is no less than 0.01% (preferably no less than 0.02%).

However, excess V and Nb cause carbides to increase which do not dissolve in austenite at the time of quenching. This results in insufficient strength and hardness, coarse nitrides, and easy fatigue breakage. Excess V also increases residual austenite, resulting in springs with low hardness. Therefore, an adequate amount of V should be no more than 0.4% (preferably no more than 0.3%), and an adequate amount of Nb should be no more than 0.1% (preferably no more than 0.05%).

Mo: no more than 0.5%

Mo is an element that improves hardenability as well as softening resistance which leads to improved settling resistance. It may optionally be added to the wire rod according to need. A desired amount of Mo should be no less than 0.01% (preferably no less than 0.05%). Excess Mo tends to cause supercooled structure at the time of hot rolling and also deteriorates ductility. An adequate amount of Mo should be no more than 0.5% (preferably no more than 0.4%).

B: no more than 0.005%

B is an element that prevents P from intergranular segregation, thereby keeping the grain boundary clean, and also improves hydrogen brittleness resistance, toughness, and ductility. It may optionally be added to the wire rod according to need. An adequate amount of B should be no less than 0.0003% (preferably no less than 0.0005%). Excess B forms B compounds, such as $Fe_{23}(CB)_6$, with the amount of free B decreasing, and hence it produces no additional effect of preventing P from intergranular segregation. Moreover, being coarse usually, these B compounds trigger fatigue breakage and deteriorate fatigue characteristics. An adequate amount of B should be no more than 0.005% (preferably no more than 0.004%).

EXAMPLES

The invention will be described in more detail with reference to the following examples, which are not intended to restrict the scope thereof but can be changed or modified within the scope thereof.

A steel sample (weighing 80 tons) with the chemical composition shown in Table 1 below was prepared by using a converter, and it was made into a cast block by continuous casting, each measuring 430 mm by 300 mm in cross section. After soaking, the cast block was bloomed into a billet measuring 155 mm square. The billet was made into a wire rod, 15.5 mm in diameter, by hot rolling. Table 2 shows the rate of cooling from 1500° C. to 1400° C. after continuous casting, the conditions of soaking, and the rate of cooling from 1200° C. to 800° C. after blooming.

(1) Measurement of Maximum Thickness of TiN Inclusions

The rolled wire rod which had been obtained as mentioned above was cut into a small piece measuring 20 mm in length. The cut piece was embedded into a resin and then ground and polished until the center line appeared. The resulting specimen has one visual field for observation under a microscope. The thickness of TiN inclusions was measured according to JIS G0555, and the maximum thickness was searched in the following manner.

First, those inclusions observed in the visual field are identified as TiN inclusions by EPMA (electron probe microanalysis). Then, one of them which has the maximum major axis is regarded as having the maximum thickness in the visual field. The length of the maximum major axis is the maximum thickness. The TiN inclusions are classified into two groups—those of D type and those of Ds type. The former are granular oxide inclusions which assume and keep angular shape or round shape or any other shape with a low aspect ratio. They are blackish or bluish randomly distributing particles. The latter are discrete granular inclusions, assuming a round or near-round shape, each particle having a major axis longer than 13 μm.

Twenty visual fields are examined for the maximum thickness of TiN inclusions observed therein. And, the ratio (%) of the visual fields classified as mentioned above is calculated. The results are shown in Table 2.

(2) Rotary Bending Fatigue Test of Ono Type

The rolled wire rod obtained as mentioned above was made into a straight rod (14.3 mm in diameter) by drawing, which was subsequently cut in a length of 70 mm. The resulting specimen was heated at 925° C. for 10 minutes, oil-quenched at 70° C. for 5 minutes, and annealed at 400° C. for 60 minutes. The heat-treated specimen was then cut into a test piece conforming to JIS Z2274, No. 1. The parallel parts of the test piece were polished with #800 emery paper. Fifty test pieces were prepared from each wire rod. The rotary bending fatigue test was carried out, with the load stress set at 750 MPa and the limiting number of rotations set at 50,000,000. Each test piece was examined for fatigue life (in terms of the number of rotations required for it to break). Among 50 test pieces, the one which broke first was regarded as having the shortest fatigue life, and the fatigue characteristics of the test pieces were evaluated according to the shortest fatigue life.

The test piece which broke first in the fatigue test was examined by EPMA for the composition of the inclusion which triggered fatigue break. It was also examined for the maximum thickness and aspect ratio (long axis/short axis) of the break-triggering inclusion. The maximum thickness and aspect ratio were determined from the size of the inclusion. For this purpose, the fracture surface (cross section) was observed under a scanning electron microscope (SEM) with a magnification suitable for the entire inclusion to be covered. Incidentally, the maximum thickness is the long axis (or the maximum length) of the inclusion. The results are shown in Table 2.

TABLE 1

| | Chemical composition of wire rod (unit: wt %, remainder: iron and inevitable impurities) | | | | | | | | | | | | | | | |
|---|---|---|---|---|---|---|---|---|---|---|---|---|---|---|---|---|
| Kind of steel | C | Si | Mn | Ni | Cr | V | Ti | Cu | Nb | Mo | B | Al | N | O | P | S |
| A | 0.61 | 2.23 | 1.00 | — | 1.75 | — | 0.003 | — | — | — | — | 0.003 | 0.0035 | 0.0008 | 0.013 | 0.012 |
| B | 0.60 | 2.06 | 0.51 | — | 1.75 | 0.310 | 0.050 | — | — | — | — | 0.002 | 0.0060 | 0.0009 | 0.005 | 0.009 |
| C | 0.61 | 2.05 | 0.95 | 0.26 | 1.02 | 0.105 | 0.095 | — | — | — | — | 0.003 | 0.0048 | 0.0003 | 0.006 | 0.003 |

TABLE 1-continued

| Kind of steel | Chemical composition of wire rod (unit: wt %, remainder: iron and inevitable impurities) | | | | | | | | | | | | | | | |
|---|---|---|---|---|---|---|---|---|---|---|---|---|---|---|---|---|
| | C | Si | Mn | Ni | Cr | V | Ti | Cu | Nb | Mo | B | Al | N | O | P | S |
| D | 0.47 | 2.10 | 0.18 | 0.70 | 1.21 | — | 0.080 | 0.50 | — | — | — | 0.005 | 0.0015 | 0.0010 | 0.003 | 0.004 |
| E | 0.68 | 2.23 | 0.36 | 0.72 | 1.98 | 0.330 | 0.075 | — | 0.050 | — | — | 0.038 | 0.0012 | 0.0008 | 0.013 | 0.009 |
| F | 0.46 | 1.91 | 0.45 | — | 1.13 | — | 0.030 | — | 0.041 | — | — | 0.005 | 0.0033 | 0.0007 | 0.012 | 0.013 |
| G | 0.52 | 1.90 | 0.25 | 0.55 | 1.78 | — | 0.001 | — | — | 0.15 | 0.0032 | 0.015 | 0.0045 | 0.0005 | 0.008 | 0.007 |
| H | 0.46 | 1.92 | 0.36 | — | 1.21 | — | 0.110 | — | — | — | — | 0.018 | 0.0028 | 0.0004 | 0.010 | 0.005 |
| I | 0.71 | 1.99 | 0.91 | — | 0.15 | — | 0.002 | — | — | — | — | 0.035 | 0.0011 | 0.0002 | 0.008 | 0.003 |
| J | 0.41 | 1.80 | 0.18 | 0.51 | 1.09 | 0.160 | 0.070 | 0.21 | — | — | — | 0.044 | 0.0072 | 0.0003 | 0.010 | 0.012 |

TABLE 2

| No. | Kind of steel | Cooling rate after continuous casting (° C./s) | Soaking Temperature (° C.) | Soaking Duration (min) | Cooling rate after blooming (° C./s) | Ratio (%) of visual fields in which TiN inclusions have the maximum thickness defined below. No larger than 5 μm | Larger than 5 μm and no larger than 10 μm | Larger than 10 μm and no larger than 25 μm | Larger than 25 μm | Rotary bending fatigue test of Ono type Shortest fatigue life (cycles) | Breakage-triggering inclusions | Maximum thickness of breakage-triggering inclusions (μm) | Aspect ratio of breakage-triggering inclusions |
|---|---|---|---|---|---|---|---|---|---|---|---|---|---|
| A-1 | A | 0.18 | 1250 | 65 | 0.24 | 0 | 30 | 70 | 0 | 35,620,000 | TiN | 24 | 1.8 |
| A-2 | | 0.55 | 1150 | 90 | 0.33 | 5 | 40 | 55 | 0 | 22,650,000 | TiN | 20 | 5.0 |
| B-1 | B | 0.64 | 1280 | 120 | 0.05 | 0 | 20 | 80 | 0 | 48,730,000 | TiN | 21 | 2.4 |
| B-2 | | 0.28 | 1350 | 100 | 0.30 | 0 | 35 | 55 | 10 | 28,200,000 | TiN | 58 | 3.5 |
| C-1 | C | 0.33 | 1200 | 120 | 0.15 | 0 | 25 | 75 | 0 | 39,850,000 | TiN | 23 | 3.6 |
| C-2 | | 0.52 | 1100 | 70 | 0.38 | 5 | 35 | 60 | 0 | 19,800,000 | TiN | 18 | 6.0 |
| C-3 | | 0.08 | 1250 | 80 | 0.25 | 5 | 40 | 55 | 5 | 28,700,000 | TiN | 57 | 3.5 |
| D-1 | D | 0.54 | 1350 | 70 | 0.10 | 0 | 25 | 75 | 0 | 42,730,000 | TiN | 24 | 1.2 |
| D-2 | | 0.11 | 1120 | 200 | 0.34 | 0 | 20 | 65 | 15 | 27,500,000 | TiN | 42 | 2.0 |
| E-1 | E | 0.18 | 1250 | 85 | 0.03 | 0 | 20 | 80 | 0 | 46,350,000 | TiN | 25 | 3.8 |
| E-2 | | 0.54 | 1180 | 50 | 0.22 | 15 | 35 | 50 | 0 | 20,600,000 | TiN | 22 | 5.5 |
| E-3 | | 0.05 | 1300 | 65 | 0.18 | 10 | 10 | 50 | 20 | 12,500,000 | TiN | 72 | 7.0 |
| F-1 | F | 0.15 | 1280 | 80 | 0.22 | 0 | 5 | 95 | 0 | 37,950,000 | TiN | 22 | 3.0 |
| F-2 | | 0.51 | 1190 | 80 | 0.31 | 10 | 50 | 40 | 0 | 17,500,000 | TiN | 21 | 8.5 |
| G-1 | G | 0.77 | 1210 | 180 | 0.18 | 0 | 20 | 80 | 0 | 41,250,000 | TiN | 25 | 3.5 |
| G-2 | | 0.16 | 1150 | 90 | 0.59 | 0 | 15 | 80 | 5 | 16,200,000 | TiN | 14 | 11.8 |
| H-1 | H | 0.18 | 1250 | 60 | 0.15 | 5 | 20 | 65 | 10 | 18,950,000 | TiN | 70 | 3.8 |
| I-1 | I | 0.22 | 1300 | 90 | 0.15 | 5 | 20 | 70 | 0 | 28,900,000 | TiN | 25 | 3.5 |
| J-1 | J | 0.54 | 1280 | 75 | 0.08 | 10 | 10 | 75 | 5 | 17,800,000 | TiN | 61 | 2.5 |

It is apparent from Tables 1 and 2 that the samples of wire rod (A-1, B-1, C-1, D-1, E-1, F-1, and G-1), which have adequate chemical compositions and also contains TiN inclusion with an adequate size, excel in fatigue characteristics, without breakage in the rotary flexural test of Ono type up to 30,000,000 cycles.

By contrast, the samples A-2, C-2, and F-2 had a short fatigue life owing to excessively fine TiN inclusions which resulted from a low soaking temperature and a high cooling rate after blooming. The sample B-2 also had a short fatigue life owing to coarse TiN inclusions which resulted from a high soaking temperature and a long duration of soaking.

The samples C-3 and E-3 had a short fatigue life owing to both coarse and fine inclusions, with a broad size distribution, which resulted from an excessively low cooling rate after continuous casting.

The samples D-2 and G-2 had a short fatigue life owing to coarse TiN inclusions which resulted probably from a low cooling rate after continuous casting despite a low soaking temperature and a high cooling rate after blooming.

The sample E-2 had a short fatigue life owing to fine TiN inclusions which resulted from an excessively low soaking temperature.

The samples H-1 and J-1 had a short fatigue life owing to the presence of both coarse and fine TiN inclusions which resulted from excessive Ti and N. The sample I-1 also had a short fatigue life owing to excess C.

Among the above-mentioned samples, A-2, C-2, E-2, E-3, F-2, and G-2 had an extremely short fatigue life because the TiN inclusions that trigger breakage have a large aspect ratio.

What is claimed is:

1. A spring wire rod which is characterized by containing

C: 0.35-0.70% (by mass hereinafter)

Si: 1.5-2.5%

Mn: 0.05-1.5%

Cr: 0.1-2%

Ti: 0.0010-0.10%

Al: 0.001-0.05% and also by containing TiN inclusions which are specified according to their thickness in terms of the ratio of each group in all visual fields are as follows:

(1) Visual fields in which the maximum thickness is no larger than 5 μm: less than 5%

(2) Visual fields in which the maximum thickness is larger than 5 μm and no larger than 10 μm: no more than 30%

(3) Visual fields in which the maximum thickness is larger than 10 μm and no larger than 25 μm: no less than 70%

(4) Visual fields in which the maximum thickness is larger than 25 μm: less than 5% said visual field being composed of two rectangular observation regions, each measuring 20 mm in the longitudinal direction and D/4 mm in the crosswise direction from the surface of the wire rod, where D is the diameter of the wire rod, which are formed when the spring wire rod is cut along its center line and the resulting longitudinal cross-section is divided into two rectangles symmetrical about the center line, the maximum thickness of TiN inclusions being measured in more than 20 visual fields, and the visual fields being classified into four groups each having the maximum thickness no larger than 5 μm, larger than 5 μm and no larger than 10 μm, larger than 10 μm and no larger than 25 μm, and larger than 25 μm.

2. The spring wire rod as defined in claim 1, in which inclusions that trigger breakage have a size such that the long axis is 30 μm and the aspect ratio is no larger than 4.0, said size being measured by taking 50 test pieces from said wire rod, subjecting them, after conditioning, to rotary bending fatigue test of Ono type with a load stress of 750 MPa, and observing under a scanning electron microscope the fracture surface of the test piece which has begun to break first at the inclusion.

3. The spring wire rod as defined in claim 1, further containing inevitable impurities N, O, P, and S, with a permissible amount thereof being no more than 0.006% for N, no more than 0.001% for O, no more than 0.015% for P, and no more than 0.015% for S.

4. The spring wire rod as defined in claim 1, which further contains at least no more than 0.7% of Cu and no more than 0.8% of Ni.

5. The spring wire rod as defined in claim 1, which further contains at least no more than 0.4% of V and no more than 0.1% of Nb.

6. The spring wire rod as defined in claim 1, which further contains no more than 0.5% of Mo.

7. The spring wire rod as defined in claim 1, which further contains no more than 0.005% of B.

* * * * *